United States Patent [19]

Hager et al.

[11] Patent Number: 4,638,697

[45] Date of Patent: Jan. 27, 1987

[54] FROZEN MEAT CUTTER

[75] Inventors: Juergen Hager, Hückeswagen; Walter Vieth, Wermelskirchen; Werner Manderla, Remscheid, all of Fed. Rep. of Germany

[73] Assignee: Magurit-Gefrierschneider GmbH, Hoehenweg, Fed. Rep. of Germany

[21] Appl. No.: 817,392

[22] Filed: Jan. 9, 1986

[30] Foreign Application Priority Data

Feb. 25, 1985 [DE] Fed. Rep. of Germany ... 8505329[U]

[51] Int. Cl.[4] ..... B26D 3/22

[52] U.S. Cl. ..... 83/356.3; 83/39; 83/664; 83/595; 241/282.2

[58] Field of Search ..... 83/356.3, 664, 594, 83/595, 39, 407, 408; 241/282.2, 292.1

[56] References Cited

U.S. PATENT DOCUMENTS

| | | | |
|---|---|---|---|
| 2,963,062 | 12/1960 | Hughes | 83/664 |
| 3,831,469 | 8/1974 | Vadas | 83/664 X |
| 3,871,590 | 3/1975 | Steffens | 241/282.2 |
| 4,590,978 | 5/1986 | Kintz et al. | 83/356.3 X |

FOREIGN PATENT DOCUMENTS

| | | | |
|---|---|---|---|
| 2719891 | 5/1977 | Fed. Rep. of Germany | 83/356.3 |

*Primary Examiner*—Donald R. Schran
*Attorney, Agent, or Firm*—Staas & Halsey

[57] ABSTRACT

A machine for cutting slabs of frozen meat into cubes comprises a rotating cutting drum having alternatingly disposed slitting discs and knife discs. The slitting discs have a contour to minimize the risk of fracturing upon penetration into the meat in that the slicing edge thereof extends over a substantial portion of their circumference and slices the slab into a plurality of strips which are cut into cubes by the knife discs.

11 Claims, 9 Drawing Figures

FROZEN MEAT CUTTER

BACKGROUND OF THE INVENTION

1. Field of the Invention

The present invention relates to machines for size reduction of meat portions and in particular to machines for cutting slabs of frozen meat into cube-like pieces.

2. Description of the Prior Art

German Patent No. 27 19 891 discloses a prior art type of machine, and this disclosure is included herewith by reference. A main frame supports a horizontal cutter shaft rotated by an electric motor. The shaft carries slitting discs and knife discs. A conveyor pushes slabs of frozen meat against the cutter shaft, and at first, the slab is sliced into strips by the slitting discs. With further approach, the strips produced by the slitting discs are cut off into cubes by the cutting edges of the knife discs.

The prior art machine referred to above is not entirely satisfactory. The cubes produced do not have cleanly cut edges, and the proportion of the finely divided particles is considerable. Moreover, if the slabs to be cut are extremely hard because of having been deep frozen, there is a risk of fracture of the slitting discs. In this regard, the slitting discs have a substantially circular contour from which hook shaped blades protrude. The blades are subjected to great physical loads upon impact with and penetration into the meat.

SUMMARY OF THE INVENTION

It is an object of the present invention to provide a frozen meat cutter of the type referred to in which the risk of fracture of the slitting discs is minimized.

It is a further object of the invention to provide a frozen meat cutter of the type referred to which slices the meat to permit the efficient production of cleanly cut cube-like portions from slabs of frozen meat.

According to the invention, the machine comprises a rotatable cutter drum made up of a plurality of side-by-side alternatingly disposed slitting discs and knife discs arranged along the drum axis. Conveyor means are provided to push slabs of frozen meat against the drum so that the slitting discs slice the slab longitudinal into strips, and the strips so formed are cut off laterally by the knife discs. The slitting discs each have a slicing edge extending between a first point on the disc which is forward relative to the direction of rotation of the drum and a trailing point, the latter being disposed at a greater radial distance from the center of the disc than the first point. In a preferred aspect of the invention, such slicing edge is presented by providing the disc with a contour resulting from at least one circular arc of smaller radius and at least one circular arc of greater radius, arcs of different radii being equal in number, the difference of the radii defining the depth of the slits.

Adjacent arcuate contour portions are joined by a straight portion to present the slicing edge. Preferably, there are two slicing edges provided on each disc and accordingly, the knife discs also are provided with two cutting edges. The conveying means preferably comprises a pushing slider cooperating with a downholder plate, and the slider and the plate have interengaging keys and grooves so to permit proper feeding of warped slabs or slab of different thicknesses.

BRIEF DESCRIPTION OF THE DRAWINGS

Embodiments of the invention will be described in detail hereinafter with reference to the accompanying drawings. The drawings are rather schematic and are intended to emphasize the improvements over the prior art.

DETAILED DESCRIPTION OF THE INVENTION

Figure 1:
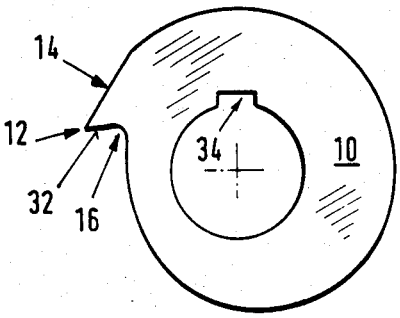
FIGS. 1, 2 and 3, respectively, illustrate the contour of three different types of discs of which are assembled to present a cutter drum.

FIG. 1 illustrates the contour of a knife disc 10 which, for purposes of simplified manufacture, is combined from two curved arc sectors of different radii to simulate a helical contour and a straight cutting edge portion 12. Adjacent cutting edge 12 of disc 10, the contour is ground place as at 14 so that resharpening is simplified. The cutting angle is about 20°. The transition area 16 is rounded in order to facilitate ejection of cut-off cubes of meat.

Figure 2:
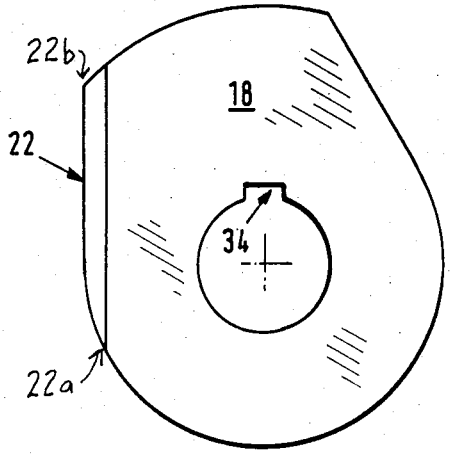
Figure 3:
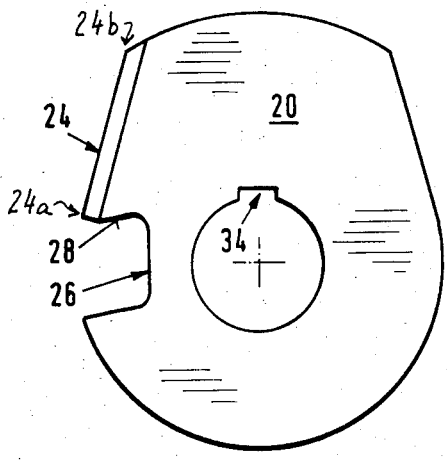

FIG. 2 illustrates a first type of slittng disc 18 while FIG. 3 illustrates a second type of slitting disc 20. Slitting discs 18 and 20 have a similar contour in that they each have a slicing edge 22 and 24, respectively. The disc 20, however, has an indentation 26 presenting an edge 28 which is substantially flush with edge 32 of the knife discs 10 after assembly of the discs 10, 18 and 20 on shaft 30 to present the drum 75. The slitting discs 10, 18 and 20 are mounted for rotation with shaft 30 in a counterclockwise direction viewing FIGS. 1, 2 and 3, and the slicing edges 22 and 24 extend between forward points **22*a* and 24*a* and trailing points 22*b* and 24*b***, respectively.

As can be seen from FIGS. 2 and 3, the points **22*a* and 24*a* are the forward points of the edges 22 and 24 relative to the direction of rotation of drum 75 and the points 22*b* and 24*b* are disposed at a greater radial distance than forward points 22*a* and 24** from the axes of rotation of the respective discs.

The key grooves 34 of the discs 18 and 20 are circumferentially offset by about 15° relative to one another in the preferred embodiment so that the relative slicing actions are slightly staggered.

Figure 4:
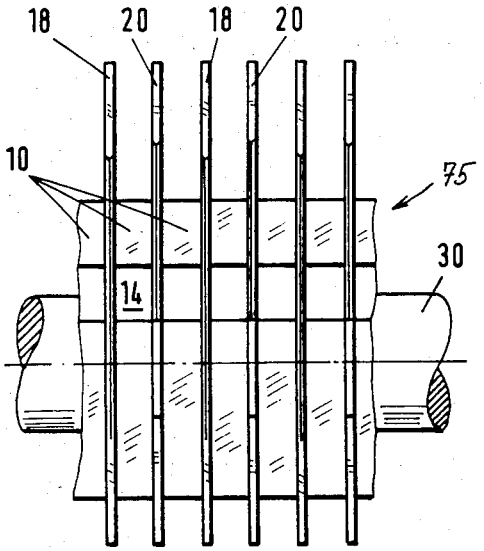
FIG. 4 is a partial front view of the drum, seen from the direction of feeding of the slabs.

As can be seen in FIG. 4, the discs are arranged on shaft 30 in the sequence 10-18-10-20-10-18-10-20 etc. to form drum 75. Accordingly, two knife discs 10 and the indentations 26 of a slitting disc 20 therebetween define a receiving space for two cubes separated from each other by the cutting edge 24 of the respective disc 20. As a result, two cut-off cubes are loosely received in said space and are easily ejected due to centrifugal force.

Figure 6:
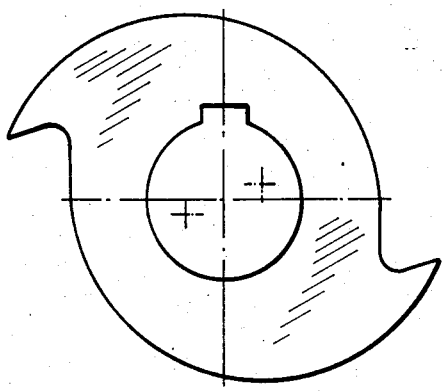
FIGS. 6, 7 and 8, respective, show in a manner similar to FIGS. 1 through 3, the discs of a preferred embodiment.
Figure 7:
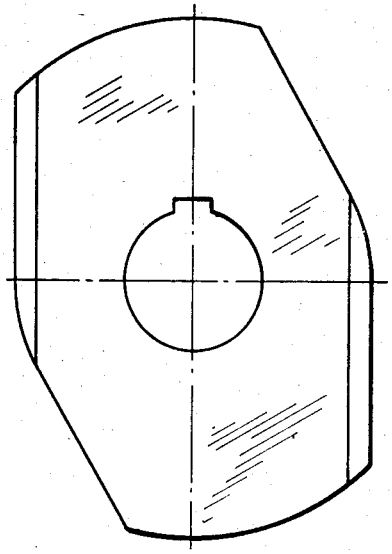
Figure 8:
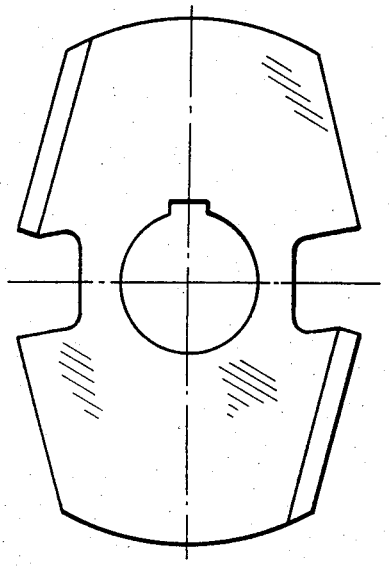

The drum so far described may exhibit a considerable unbalance upon rotation which must be compensated by means of counterweights at the shaft ends (not shown). It is thus preferred to double the number of cutting edges for all discs, as illustrated in FIGS. 6, 7 and 8, respectively. A drum constructed of the discs shown in FIGS. 6, 7 and 8 may be more expensive to manufacture but will exhibit at most a rotational unbalance due to manufacturing tolerances which is easy to compensate.

Figure 5:
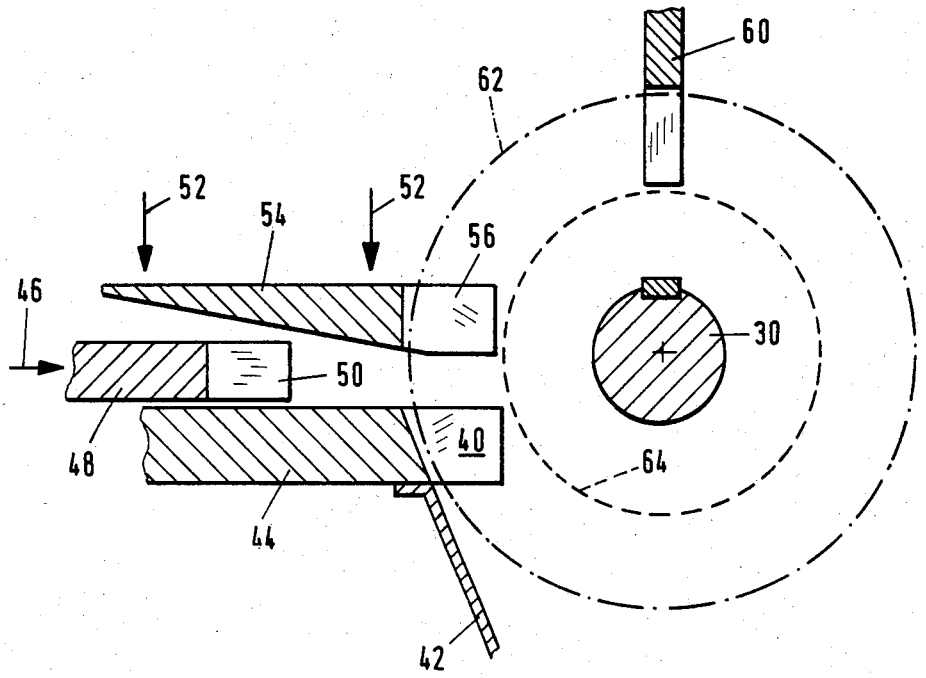
FIG. 5 illustrates in vertical sectional view the machine portion adjacent the cutting site.

In FIG. 5 for sake of simplicity only the flight paths 62 of the slitting discs and the flight paths 64 of the knife discs are indicated in dash-dotted and broken lines, respectively. A frozen meat slab to be cut (not shown) is put on a table 44 which extends with projections 40 between the slitting discs. At the bottom of table 44, a chute 42 is mounted leading to a cube receptacle (not shown). Above table 44, a slider 48 is reciprocably movable in direction of arrow 46 so to push a meat slab along table 44 into the operating area of the drum. Slider 48 also has projections 50 extending between discs 18 and 20. Above slider 48 there is a downholder 54 that is spring-biased in the direction of arrows 52. Again, the downholder has slots permitting passage of the slitting discs and presents fingers 56 projecting between adjacent discs. The inlet between table 44 and downholder 54 tapers outwardly so that meat slabs in spite of frequently being warped may properly be fed under downholder 54. When a slab is almost entirely cubed, the slider 48 will somewhat lift the downholder unless it has not yet been lifted by the slab itself. A comb plate 60 engages with tines from above and between the slitting discs so as to remove cubes which have not been entirely ejected by centrifugal force.

The slider may be driven by means of a pneumatic cylinder, as illustrated in the referenced German Patent, or it may be driven by mechanical gear means synchronized with the drum. It has been found that with either design, proper cubes are produced and the proportion of chips is small.

Figure 9:
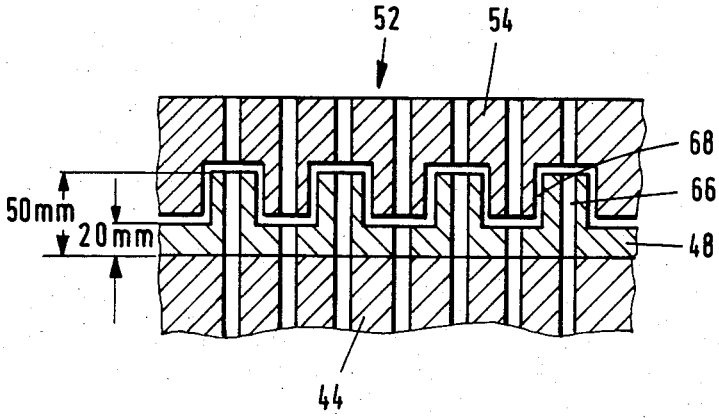
FIG. 9 is a partial sectional view of a slider and downholder having an improved design, the sectional plane being between the path of movement of the slitting discs and knife discs.

FIG. 9 illustrates an improved design of the slider-downholder-assembly. The slider 48 is provided on its upper face with keys 66 extending into complimentary grooves 68 of the downholder 54. This permits the slider to be safely push extremely warped slabs or two superposed slabs while even one very thin slab is safely held down on the table by the downholder 54.

We claim:

1. In a machine for slicing and cutting slabs of frozen meat into generally cube-like portions, a rotatable slicing and cutting drum comprising:

a plurality of side-by-side, alternatingly disposed slitting discs and knife discs mounted for rotation together as a unit, said slitting discs being operable to make parallel longitudinal slices in a meat slab fed radially against the drum as the latter rotates to thereby produce a plurality of side-by-side meat strips, said knife discs being operable to cut the meat strips laterally into individual cube-like portions, said slitting discs having a slicing edge extending between a first point on the disc which is forward relative to the direction of rotation of the drum, and a trailing point, said trailing point being disposed at a greater radial distance from the axis of rotation of the disc than said first point.

2. A machine as set forth in claim 1 wherein said slitting discs have a contour presented by at least one arc portion of small radius and at least one arc portion of greater radius, arc portions of different radii being equal in number, said first point being located on a small radius arc portion and said trailing point being located on a greater radius arc portion whereby said slicing edge extends along the transition between said smaller radius portion and said greater radius portion.

3. A machine as set forth in claim 2, wherein each knife disc has two diametrically opposite cutting edges and wherein each slitting disc has two slicing edges opposite each other.

4. A machine as set forth in claim 2, wherein said slitting discs are alternatingly offset in circumferential direction by a predetermined angle.

5. A machine as set forth in claim 2, wherein every other slitting disc on the drum has an indentation at the angular position of the cutting edge of said knife discs.

6. A machine as set forth in claim 2 and comprising a table and conveying means adapted to feed meat slabs to be cut radially towards said drum, said table having projections extending between said slitting discs.

7. A machine as set forth in claim 6, wherein said conveying means comprises a slider reciprocably movable along said table and having fingers which, with the slider being in an end position next to said drum, extend between said slitting discs.

8. A machine as set forth in claim 7 and comprising a downholder member above said table and above said slider, said member being spring-biased against said table and having fingers which project between said slitting discs.

9. A machine as set forth in claim 8 wherein a meat slab inlet is defined between said table and said downholder member, said inlet tapering outwards away from said drum.

10. A machine as set forth in claim 8 wherein said slider is provided with keys extending in parallel to its reciprocation direction and into complimentary slots of said downholder member.

11. A machine as set forth in claim 2 wherein a comb plate is stationarily disposed above said drum and extends with fingers between said slitting discs in a position to scrape meat cubes from said drum.

* * * * *